US007635123B2

(12) United States Patent
Watanabe et al.

(10) Patent No.: US 7,635,123 B2
(45) Date of Patent: Dec. 22, 2009

(54) IMAGE FORMING APPARATUS, IMAGE FORMING METHOD, AND BYPASS SHEET SUPPLIER CAPABLE OF REGULATING AND SUPPLYING RECORDING MEDIUM

(75) Inventors: Koji Watanabe, Aichi (JP); Manabu Nonaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 302 days.

(21) Appl. No.: 11/516,929

(22) Filed: Sep. 6, 2006

(65) Prior Publication Data

US 2007/0057429 A1 Mar. 15, 2007

(30) Foreign Application Priority Data

Sep. 14, 2005 (JP) ..... 2005-266452

(51) Int. Cl.
*B65H 3/44* (2006.01)
*B65H 5/26* (2006.01)
*B65H 9/04* (2006.01)

(52) U.S. Cl. ..... 271/9.09; 271/245; 271/258.04; 271/259; 271/121

(58) Field of Classification Search ..... 271/171, 271/121, 9.09, 145, 245, 258.04, 258.01, 271/259; 399/393
See application file for complete search history.

(56) References Cited

U.S. PATENT DOCUMENTS 4,657,239 A * 4/1987 Ikesue et al. ..... 271/227
4,874,160 A * 10/1989 Yamamoto ..... 271/227
4,908,673 A * 3/1990 Muramatsu ..... 399/402
5,379,998 A * 1/1995 Nakagawa ..... 271/248
6,073,925 A * 6/2000 Sato ..... 271/171
6,648,327 B1 * 11/2003 Lin ..... 271/265.02
6,746,012 B2 * 6/2004 Diews ..... 271/164
6,851,613 B2 * 2/2005 Yoshii ..... 235/479
6,948,710 B2 9/2005 Togashi et al.
6,955,350 B2 * 10/2005 Hashiguchi et al. ..... 271/255
7,142,805 B2 * 11/2006 Mizuno et al. ..... 399/392
2002/0096820 A1 * 7/2002 Diews ..... 271/171
2005/0088504 A1 4/2005 Kudoh et al.
2005/0104927 A1 5/2005 Kudoh et al.
2005/0146554 A1 7/2005 Asanuma et al.
2005/0194730 A1 9/2005 Nishida et al.
2006/0255531 A1 * 11/2006 Azzopardi et al. ..... 271/171

FOREIGN PATENT DOCUMENTS

JP 3-138256 6/1991
JP 8-113379 5/1996

* cited by examiner

*Primary Examiner*—Patrick H Mackey
*Assistant Examiner*—Luis Gonzalez
(74) *Attorney, Agent, or Firm*—Cooper & Dunham, LLP

(57) ABSTRACT

An image forming apparatus includes a bypass sheet supplier configured to supply a recording medium and an image forming mechanism configured to form an image on the recording medium sent from the bypass sheet supplier according to image data. The bypass sheet supplier includes a bypass tray, a lateral side fence, and a sensor unit. The bypass tray is configured to load the recording medium. The lateral side fence is configured to regulate the recording medium in a main scanning direction. The sensor unit is configured to detect whether a lateral edge of the recording medium extending in a sub-scanning direction contacts the lateral side fence.

10 Claims, 10 Drawing Sheets

IMAGE FORMING APPARATUS, IMAGE FORMING METHOD, AND BYPASS SHEET SUPPLIER CAPABLE OF REGULATING AND SUPPLYING RECORDING MEDIUM

FIELD

The present specification describes an image forming apparatus, an image forming method, and a bypass sheet supplier, and more particularly an image forming apparatus, an image forming method, and a bypass sheet supplier for supplying a recording medium of various types and sizes for image forming.

DISCUSSION OF THE BACKGROUND

A related art image forming apparatus, such as a copying machine, a printer, a facsimile machine, or a multifunction printer including copying, printing, scanning, and facsimile functions, forms an image on a recording medium (e.g., a sheet) according to image data. The sheet is typically stored in a paper tray provided in the image forming apparatus and is supplied from the paper tray to an image forming mechanism for forming an image on the sheet with a developer such as ink or toner.

The related-art image forming apparatus can be provided with a plurality of the paper trays to handle sheets of various sizes. However, when a user wants the image forming apparatus to form an image on a sheet having a particular size and the sheet having the particular size is not stored in any one of the plurality of the paper trays, the user needs to replace sheets in one of the plurality of the paper trays with the sheet having the particular size, resulting in a reduced user-friendliness.

To address this problem, the related-art image forming apparatus may further be provided with a bypass tray for handling the sheet having the particular size which is not stored in the plurality of the paper trays and special sheets including thick paper and OHP (overhead projector) transparencies. The bypass tray is generally opened from a side of the image forming apparatus. To properly set a sheet on the bypass tray, the user inserts the sheet into the bypass tray and moves side fences provided on the bypass tray so that the side fences regulate the sheet on the bypass tray. However, when the sheet is not properly set (e.g., when the sheet is not regulated in a main scanning direction), the sheet may not be properly sent from the bypass tray and may be skewed or jammed while the image forming mechanism forms an image on the sheet.

An improved mechanism for supplying sheets from a bypass tray is needed.

SUMMARY

This patent specification describes a novel approach for supplying sheets from a bypass tray in image forming equipment. In one example, a novel image forming apparatus includes a bypass sheet supplier configured to supply a recording medium and an image forming mechanism configured to form an image on the recording medium sent from the bypass sheet supplier according to image data. The bypass sheet supplier includes a bypass tray, a lateral side fence, and a sensor unit. The bypass tray is configured to load the recording medium. The lateral side fence is configured to regulate the recording medium in a main scanning direction. The sensor unit is configured to detect whether a lateral edge of the recording medium extending in a sub-scanning direction contacts the lateral side fence.

One example of a novel image forming method includes detecting whether a recording medium set on a bypass tray is contacted by a lateral side fence configured to regulate the recording medium in a main scanning direction, and issuing one of a first warning and a first guidance indicating that the recording medium is not properly set on the bypass tray when the recording medium is not contacted by the lateral side fence. The method further includes detecting whether or not a foremost edge of the recording medium contacts a shutter disposed near the bypass tray and configured to regulate the recording medium in a sub-scanning direction, and issuing one of a second warning and a second guidance indicating that the recording medium is not properly set on the bypass tray when the foremost edge of the recording medium does not contact the shutter. In addition, the method includes detecting an event that an image forming mechanism is lifted up to a predetermined height, detecting an event that there is no recording medium being conveyed, detecting an event that an output tray, which is to receive the recording medium conveyed from the image forming mechanism without being reversed, is opened. The novel image forming method further includes opening the shutter to convey the recording medium from the bypass tray to the image forming mechanism, and forming an image on the recording medium according to image data.

This patent specification further describes a novel bypass sheet supplier, and in one example, the bypass sheet supplier includes a bypass tray, a lateral side fence, and a sensor unit. The bypass tray is configured to load a recording medium. The lateral side fence is configured to regulate the recording medium in a main scanning direction. The sensor unit is configured to detect whether a lateral edge of the recording medium extending in a sub-scanning direction contacts the lateral side fence.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
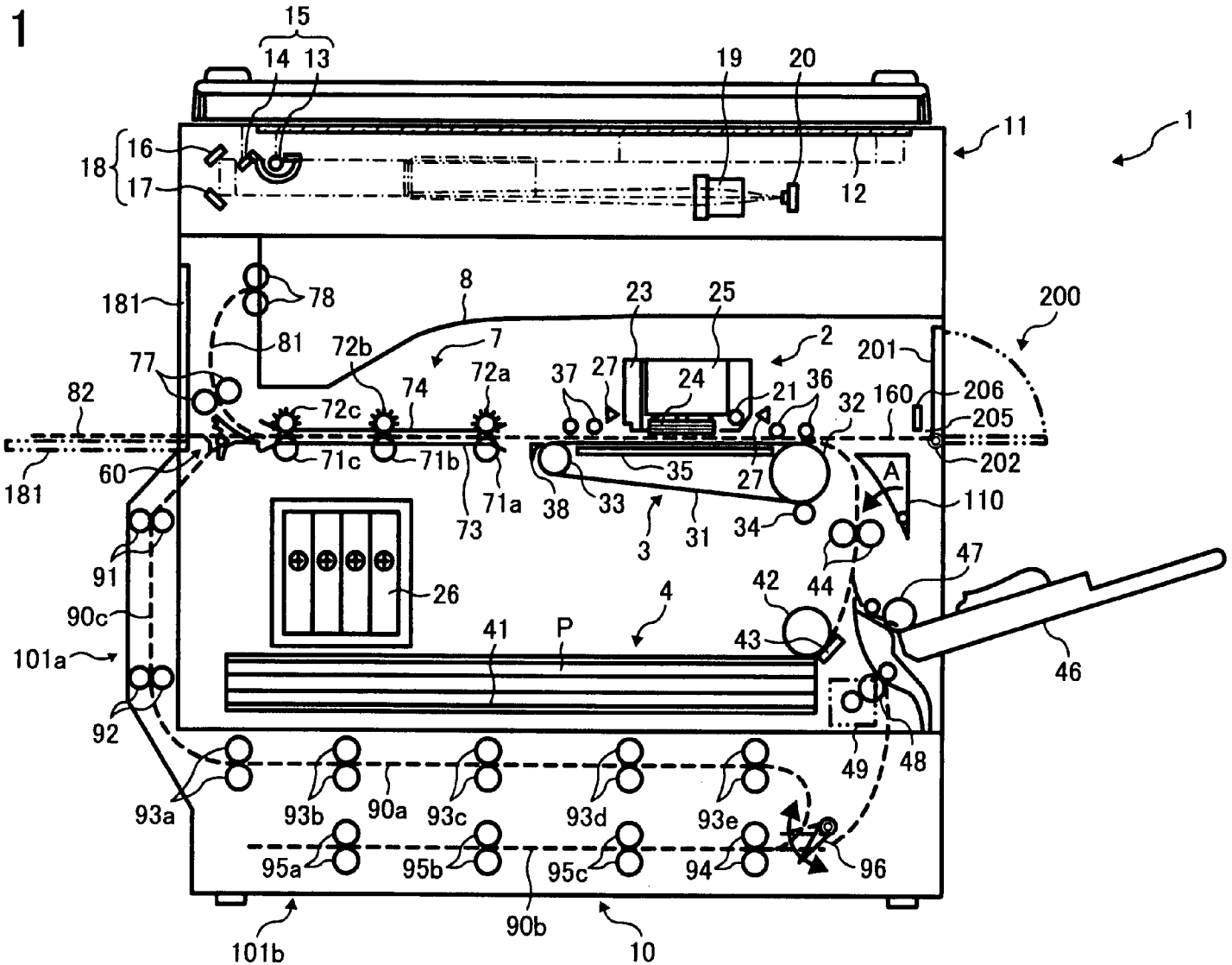
FIG. 1 is a schematic view of an image forming apparatus according to an exemplary embodiment.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment is explained.

FIG. 1 is a schematic view of the image forming apparatus 1. As illustrated in FIG. 1, the image forming apparatus 1 includes a reader 11, an image forming unit 2, a paper tray unit 4, a sub-scanning direction conveyer 3, an output conveyer 7, a duplex unit 10, a guide 110, a bypass sheet supplier 200, a bypass conveying path 160, and ink cartridges 26.

The image forming apparatus 1 includes a copying machine, a printer, a facsimile machine, and a multifunction printer including copying, printing, scanning, and facsimile functions. In this non-limiting exemplary embodiment, the image forming apparatus 1 functions as a color copying machine for forming a color image on a recording medium.

The reader 11 is disposed in an upper portion of the image forming apparatus 1 and scans an image on an original sheet to generate image data. The image forming unit 2 forms an image on a recording medium according to the image data generated by the reader 11. The paper tray unit 4 is attachable to and detachable from a front of the image forming apparatus 1 and loads a recording medium including sheets P. The sub-scanning direction conveyer 3 turns a direction in which a sheet P fed from the paper tray unit 4 is conveyed by about 90 degrees so that the sheet P opposes the image forming unit 2, and conveys the sheet P towards the output conveyer 7. The output conveyer 7 conveys and outputs the sheet P. The duplex unit 10 reverses the sheet P fed from the output conveyer 7 and feeds the sheet P towards the image forming unit 2 so that an image is formed on the other side of the sheet P. The guide 110 is disposed between the paper tray unit 4 and the sub-scanning direction conveyer 3 and swings to slack the sheet P fed from the paper tray unit 4. The bypass sheet supplier 200 loads a sheet P including thick paper and an OHP (overhead projector) transparency. The bypass conveying path 160 conveys the sheet P sent from the bypass sheet supplier 200 towards the sub-scanning direction conveyer 3 and the image forming unit 2. The ink cartridges 26 are attachable to and detachable from the front of the image forming apparatus 1 and contain black, cyan, magenta, and yellow ink, respectively.

The reader 11 includes an exposure glass 12, optical scanning systems 15 and 18, a lens 19, and a scanning element 20. The optical scanning system 15 includes a light source 13 and a mirror 14. The optical scanning system 18 includes mirrors 16 and 17.

An original sheet having an image is placed on the exposure glass 12 facing down. The optical scanning systems 15 and 18 move to scan the image on the original sheet. The light source 13 irradiates light onto the original sheet placed on the exposure glass 12. The mirror 14 deflects the light reflected by the original sheet towards the mirror 16. The mirror 16 further deflects the light deflected by the mirror 14 towards the mirror 17. The mirror 17 further deflects the light deflected by the mirror 16 towards the lens 19. The lens 19 irradiates the light deflected by the mirror 17 towards the scanning element 20. The scanning element 20 converts the light into an image signal. The image signal is digitized and processed to generate image data.

The image forming apparatus 1 may also receive image data sent from an information processing device (e.g., a personal computer), an image scanning device (e.g., an image scanner), or a capturing device (e.g., a digital camera) via a cable or a network.

The image forming unit 2 includes a guide rod 21, a carriage 23, recording heads 24, sub tanks 25, and a carriage sensor 27. The guide rod 21 supports the carriage 23 together with a stay (not shown) in a state that the carriage 23 may move in a main scanning direction. The carriage 23 carries the recording heads 24. The recording heads 24 discharge liquid drops onto a sheet P sent from the paper tray unit 4 according to the image data generated by the reader 11. The sub tanks 25 are mounted on the carriage 23 and contain ink to be supplied to the recording heads 24. The carriage sensor 27 detects whether the carriage 23 is lifted up to a predetermined height or not.

The paper tray unit 4 includes a paper tray 41, a feeding roller 42, a friction pad 43, a bypass tray 46, a bypass tray roller 47, a conveying roller 48, a feeding motor 49, and a registration roller pair 44. The paper tray 41 loads sheets P. The feeding roller 42 and the friction pad 43 feed the sheets P from the paper tray 41 one by one towards the registration roller pair 44. The bypass tray 46 loads sheets P. The bypass tray roller 47 feeds the sheets P from the bypass tray 46 one by one towards the registration roller pair 44. The conveying roller 48 feeds a sheet P fed from another paper tray (not shown), which may be optionally attached to a lower portion of the image forming apparatus 1, or the duplex unit 10 towards the registration roller pair 44. The feeding motor 49 includes an HB (hybrid) type stepping motor and rotatably drives members for feeding the sheet P towards the sub-scanning direction conveyer 3, such as the feeding roller 42, the registration roller pair 44, the bypass tray roller 47, and the conveying roller 48, via an electromagnetic clutch (not shown). The registration roller pair 44 temporarily stops the sheet P fed by the feeding roller 42, the bypass tray roller 47, or the conveying roller 48.

The sub-scanning direction conveyer 3 includes a conveying belt 31, a conveying roller 32, a driven roller 33, a charging roller 34, a guide 35, two pressing rollers 36, two spur rollers 37, and a separating nail 38.

The conveying belt 31 is formed in an endless belt-like shape and is looped over the conveying roller 32 and the driven roller 33. The conveying roller 32 rotates the conveying belt 31. The driven roller 33 is rotated by the rotating conveying belt 31. The charging roller 34 applies a high, alternating voltage to charge a surface of the conveying belt 31. The guide 35 opposes the image forming unit 2 and guides the rotating conveying belt 31. The pressing rollers 36 oppose the conveying roller 32 via the conveying belt 31 and press the sheet P conveyed on the conveying belt 31 towards the conveying belt 31. The spur rollers 37 press the sheet P having an image formed by the image forming unit 2 and conveyed on the conveying belt 31 towards the conveying belt 31. The separating nail 38 separates the sheet P having the image from the conveying belt 31.

A sub-scanning direction motor (not shown) rotatably drives the conveying roller 32 via a timing belt (not shown) and a timing roller (not shown) so that the rotating conveying roller 32 rotates the conveying belt 31. The conveying belt 31 includes two layers, that is, a front layer which attracts the sheet P and a back layer which forms a medium resistive layer or a grounded layer. The front layer includes a resin material for which resistance control is not performed [e.g., an ETFE (ethylene tetrafluororethylene) material]. The back layer includes a material common to the front layer, for which resistance control is performed by using a carbon. However, the conveying belt 31 may include one layer or three or more layers.

The sub-scanning direction conveyer 3 further includes a cleaner (not shown) and a discharging brush (not shown). The cleaner is disposed between the driven roller 33 and the charging roller 34 and removes paper dust or the like adhered to the surface of the conveying belt 31. The discharging brush discharges the surface of the conveying belt 31.

The sub-scanning direction conveyer 3 further includes a rotary coder (not shown). The rotary coder includes a high-resolution code hole (not shown) and a transmission photo sensor (not shown). The high-resolution code hole is attached to a shaft of the conveying roller 32. The transmission photo sensor detects a slit (not shown) formed in the high-resolution code hole.

The sub-scanning direction conveyer 3 further includes a linear encoder (not shown) and a joint sensor (not shown). The linear encoder includes a linear scale (not shown) and a reflection photo sensor (not shown). The linear scale is formed on an inner circumferential surface of the conveying belt 31, which contacts an outer circumferential surface of the conveying roller 32. The reflection photo sensor detects the linear scale. The linear scale may be formed in a stripe pattern by evaporating aluminum onto the inner circumferential surface of the conveying belt 31 and then irradiating a laser beam. The linear scale is disposed on a portion of the inner circumferential surface of the conveying belt 31 where the guide 35 may not disturb the detection by the reflection photo sensor. The joint sensor is adjacent to the reflection photo sensor and detects a joint of the linear scale provided on the inner circumferential surface of the conveying belt 31.

The output conveyer 7 includes three conveying rollers 71*a*, 71*b*, and 71*c*, three spur rollers 72*a*, 72*b*, and 72*c*, a lower guide 73, an upper guide 74, a first output path 81, a reverse roller pair 77, an output roller pair 78, an output tray 8, a second output path 82, a straight output tray 181, and a switching mechanism 60.

The conveying rollers 71*a*, 71*b*, and 71*c* convey the sheet P separated from the conveying belt 31 by the separating nail 38 towards the switching mechanism 60. The spur rollers 72*a*, 72*b*, and 72*c* oppose the conveying rollers 71*a*, 71*b*, and 71*c* and convey the sheet P towards the switching mechanism 60. The lower guide 73 and the upper guide 74 guide the sheet P conveyed by the conveying rollers 71*a*, 71*b*, and 71*c* and the spur rollers 71*a*, 72*b*, and 71*c*. The first output path 81 leads the sheet P to the output tray 8 so that the sheet P is reversed and output onto the output tray 8 facing down. The reverse roller pair 77 and the output roller pair 78 are disposed on the first output path 81 and feed the sheet P towards the output tray 8. The output tray 8 receives the sheet P fed by the output roller pair 78. The second output path 82 leads the sheet P to the straight output tray 181. The straight output tray 181 receives the sheet P fed by the conveying roller 71*c* and the spur roller 71*c*. The switching mechanism 60 moves to guide the sheet P towards the first output path 81, the second output path 82, or the duplex unit 10.

The duplex unit 10 includes a vertical conveyer 101*a* and a horizontal conveyer 101*b*. The vertical conveyer 101*a* includes a vertical path 90*c*. The horizontal conveyer 101*b* includes a horizontal path 90*a*, a switchback path 90*b*, and a switching board 96. The vertical path 90*c* includes an entrance roller pair 91 and a conveying roller pair 92. The horizontal path 90*a* includes five conveying roller pairs 93*a*, 93*b*, 93*c*, 93*d*, and 93*e*. The switchback path 90*b* includes three conveying roller pairs 95*a*, 95*b*, and 95*c* and an exit roller pair 94.

The vertical conveyer 101*a* conveys the sheet P guided by the switching mechanism 60 towards the horizontal conveyer 101*b*. The horizontal conveyer 101*b* conveys the sheet P conveyed from the vertical conveyer 101*a* towards the conveying roller 48. The vertical path 90*c* leads the sheet P downward towards the horizontal path 90*a*. The horizontal path 90*a* leads the sheet P towards the switchback path 90*b*. The switchback path 90*b* switches back the sheet P and leads the sheet P towards the conveying roller 48. The switching board 96 swings to switch between a position illustrated in a solid line and a position illustrated in a broken line. When the switching board 96 is positioned at the position illustrated in the solid line, the sheet P is fed from the horizontal path 90*a* towards the switchback path 90*b*. When the switching board 96 is positioned at the position illustrated in the broken line, the sheet P is fed from the switchback path 90*b* towards the conveying roller 48.

The entrance roller pair 91 feeds the sheet P guided by the switching mechanism 60 downward to the conveying roller pair 92. The conveying roller pair 92 further feeds the sheet P towards the conveying roller pair 93*a*. The conveying roller pairs 93*a*, 93*b*, 93*c*, 93*d*, and 93*e* feed the sheet P towards the exit roller pair 94. The exit roller pair 94 feeds the sheet P toward the conveying roller pairs 95*c*, 95*b*, and 95*a*. The exit roller pair 94 and the conveying roller pairs 95*c*, 95*b*, and 95*a* also function as reverse rollers. The conveying roller pairs 95*c*, 95*b*, and 95*a* feed the sheet P towards the exit roller pair 94. The exit roller pair 94 feeds the sheet P towards the conveying roller 48. The conveying roller 48 feeds the sheet P towards the registration roller pair 44.

When the sheet P fed from the paper tray 41, the bypass tray 46, or the duplex unit 10 is further fed by the registration roller pair 44 towards the sub-scanning direction conveyer 3, the guide 110 swings in a direction A to slack the sheet P so as to prevent the sheet P from being tensioned backward.

When the registration roller pair 44 feeds the sheet P towards the sub-scanning direction conveyer 3, the guide 110 swings in the direction A and guides the sheet P towards the sub-scanning direction conveyer 3. When the sheet P reaches the sub-scanning direction conveyer 3, the guide 110 swings back to. the original position. Thus, the sheet P is slacked.

The bypass sheet supplier 200 includes a bypass tray 201, a shaft 202, an opening 205, and a shutter 206. The bypass tray 201 is openable from and closable to one side of the image forming apparatus 1. To insert a sheet P into the bypass tray 201, the bypass tray 201 is opened to an open position illustrated in a chain double-dashed line in FIG. 1. The shaft 202 supports the bypass tray 201 in a state in which the bypass tray 201 is openable from and closable to the image forming apparatus 1. The opening 205 is disposed downstream of the bypass tray 201 in a sheet conveyance direction and is opened and closed by the shutter 206. The shutter 206 is disposed upstream of the sub-scanning direction conveyer 3 in the sheet conveyance direction. The shutter 206 closes to regulate the sheet P inserted into the bypass tray 201 in a sub-scanning direction and opens to send the sheet P to the bypass conveying path 160 through the opening 205. When a sheet P is inserted into the bypass tray 201, the shutter 206 regulates the sheet P in the sub-scanning direction. When there is no sheet under image processing in the image forming apparatus 1 and the carriage sensor 27 outputs an ON signal after detecting that the carriage 23 is lifted up to the predetermined height, the shutter 206 opens to send the sheet P to the bypass conveying path 160. A top surface of the guide 110 guides the sheet P towards a nip formed between the pressing roller 36 and the conveying belt 31.

Figure 2:
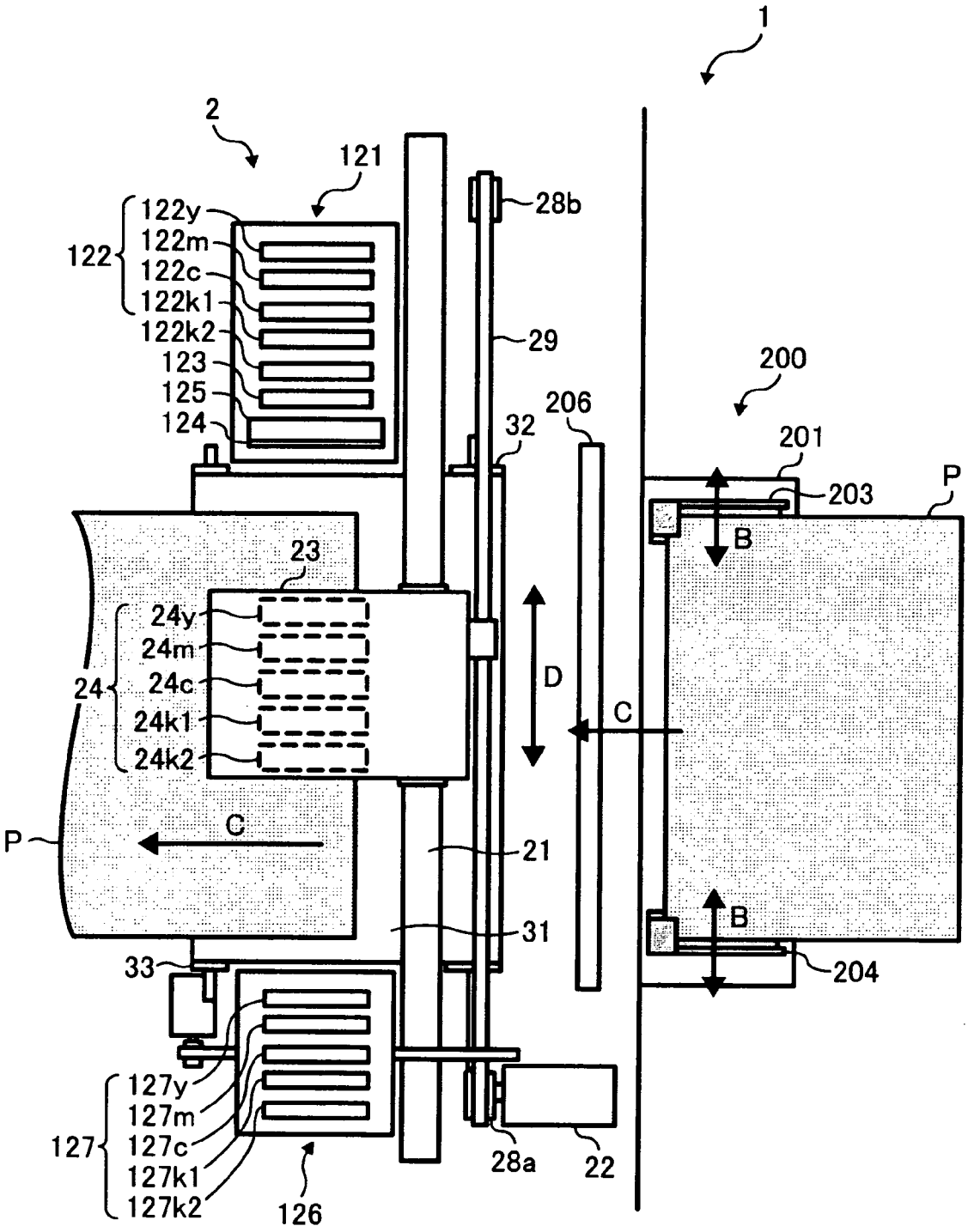
FIG. 2 is a top view of a bypass sheet supplier and an image forming unit of the image forming apparatus shown in FIG. 1.

FIG. 2 is a top view of the image forming unit 2 and the bypass sheet supplier 200 of the image forming apparatus 1. As illustrated in FIG. 2, the image forming unit 2 includes a timing belt 29, a main scanning motor 22, a driving pulley 28*a*, a driven pulley 28*b*, a maintenance-recovery mechanism 121, and an idle discharge receiver 126.

The recording heads 24 include liquid drop discharging heads 24*k*2, 24*k*l, 24*c*, 24*m*, and 24*y*. The maintenance-recovery mechanism 121 includes moisture retention caps 122, a sucking cap 123, an idle discharge receiver 125, and a wiper blade 124. The moisture retention caps 122 include moisture retention caps 122*k*2, 122*k*1, 122*c*, 122*m*, and 122*y*. The idle discharge receiver 126 includes openings 127. The openings 127 include openings 127*k*2, 127*k*1, 127*c*, 127*m*, and 127*y*.

The bypass sheet supplier 200 includes side fences 203 and 204. The side fences 203 and 204 in the embodiment of FIG. 2 are disposed on the bypass tray 201 and guide or constrain movement of the sheet P in the main scanning direction (i.e., directions D). The side fences 203 and 204 are interlocked via a rack and a pinion to simultaneously slide in directions B. Specifically, the side fences 203 and 204 simultaneously move closer to each other or simultaneously move away from each other. However, as an alternative, one of the side fences 203 and 204 may be fixed and disposed on the bypass tray 201, and the other regulates the sheet P to contact or touch the one of the side fences 203 and 204.

The timing belt 29 is looped over the driving pulley 28*a* and the driven pulley 28*b*. The main scanning motor 22 drives the driving pulley 28*a*. The driving pulley 28*a* rotates the timing belt 29 and drives the driven pulley 28*b* via the timing belt 29. The rotating timing belt 29 moves the carriage 23 supported by the guide rod 21 and the stay in the main scanning direction (i.e., the directions D).

The recording heads 24 are mounted on the carriage 23 and discharge liquid drops in a shuttle method. Specifically, while the sheet P is conveyed on the conveying belt 31 rotating in the direction C, the recording heads 24 on the carriage 23 moving in the directions D discharge liquid drops onto the sheet P. However, the recording heads 24 may be configured to discharge liquid drops in a line method in which the recording heads 24 discharge liquid drops without moving in the main scanning direction.

The liquid drop discharging heads 24*k*2 and 24*k*1 discharge black ink. The liquid drop discharging heads 24*c*, 24*m*, and 24*y* discharge cyan, magenta, and yellow inks, respectively. The black, cyan, magenta, and yellow inks are supplied from the sub tanks 25 illustrated in FIG. 1.

The sub tanks 25 include five tanks. Two of the five tanks contain black ink. The other three tanks contain cyan, magenta, and yellow inks, respectively. The ink cartridges 26 include four ink cartridges respectively containing black, cyan, magenta, and yellow ink. Black ink is supplied from one ink cartridge containing the black ink to two tanks for containing the black ink. Cyan, magenta, and yellow inks are supplied from the other three ink cartridges containing the cyan, magenta, and yellow inks, respectively, to the other three tanks for containing cyan, magenta, and yellow inks, respectively.

Multiple types of the recording heads 24, including piezo, thermal, and electrostatic types, may be used. The piezo type recording head uses a piezoelectric element as a pressure generator (e.g., an actuator) for applying pressure on ink in an ink flow route (e.g., a pressure generating room) to deform a vibration board forming walls of the ink flow route, so that a changed volume of the ink flow route discharges an ink drop. The thermal type recording head uses a heat generating resistance body to generate a bubble by boiling ink in an ink flow route, so that pressure of the bubble discharges an ink drop. The electrostatic type recording head uses a vibration board forming walls of an ink flow route and an electrode, which oppose each other, so that the vibration board deformed by an electrostatic force generated between the vibration board and the electrode changes a volume of the ink flow route and discharges an ink drop.

The maintenance-recovery mechanism 121 is disposed in a non-printing area near one end of the guide rod 21 in the main scanning direction, and maintains and recovers conditions of nozzles of the recording heads 24. The five moisture retention caps 122*k*2, 122*k*1, 122*c*1, 122*m*1, and 122*y* respectively cap nozzles of the recording heads 24*k*2, 24*k*1, 24*c*, 24*m*, and 24*y*. The sucking cap 123 sucks a liquid drop. The idle discharge receiver 125 receives a liquid drop which is discharged during idle discharge and is not used for printing. The wiper blade 124 wipes the nozzles of the recording heads 24.

The idle discharge receiver 126 is disposed in another non-printing area near the other end of the guide rod 21 in the main scanning direction. The openings 127 receive liquid drops which are discharged from the recording heads 24 during idle discharge and are not used for printing. The openings 127*k*2, 127*k*1, 127*c*, 127*m*, and 127*y* respectively receive the liquid drops discharged from the recording heads 24*k*2, 24*k*1, 24*c*, 24*m*, and 24*y*.

Figure 3A:
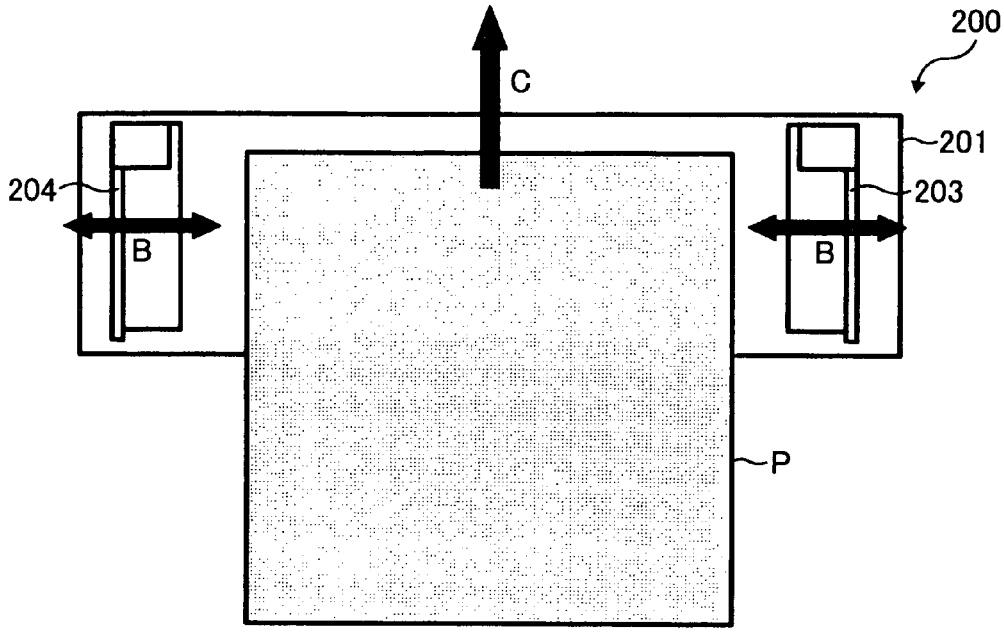
FIG. 3A is a top view of the bypass sheet supplier shown in FIG. 2.
Figure 3B:
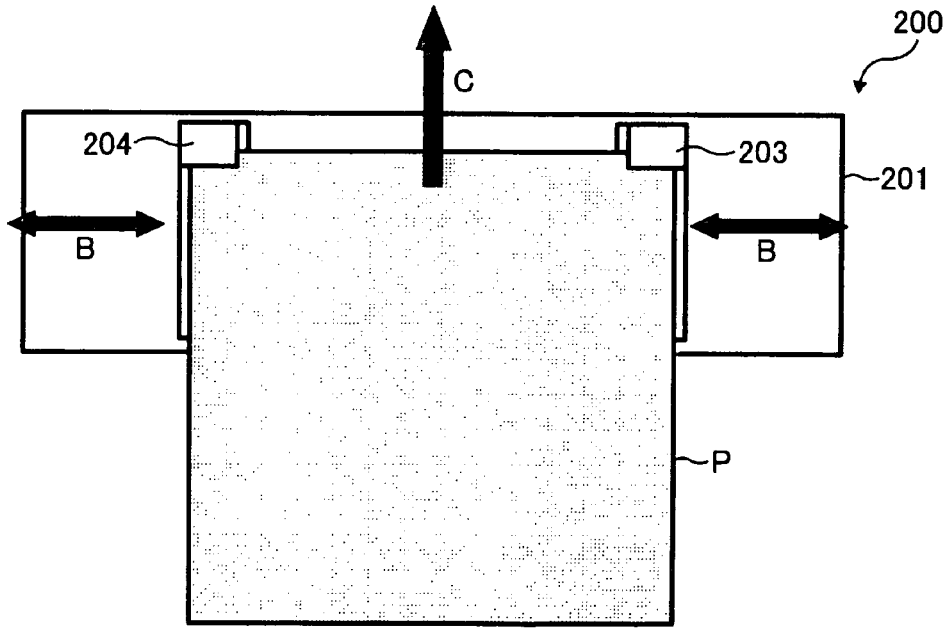
FIG. 3B is another top view of the bypass sheet supplier shown in FIG. 2.

FIGS. 3A and 3B illustrate top views of the bypass sheet supplier 200. As illustrated in FIG. 3A, a user inserts a sheet P into the bypass tray 201 and slides the side fences 203 and 204 in the directions B. After the side fences 203 and 204 are maneuvered in the directions of B toward each other, the side fences 203 and 204 hold respective side edges of the sheet P to guide or regulate the sheet P in the main scanning direction (i.e., the direction B) as illustrated in FIG. 3B.

Figure 4B:
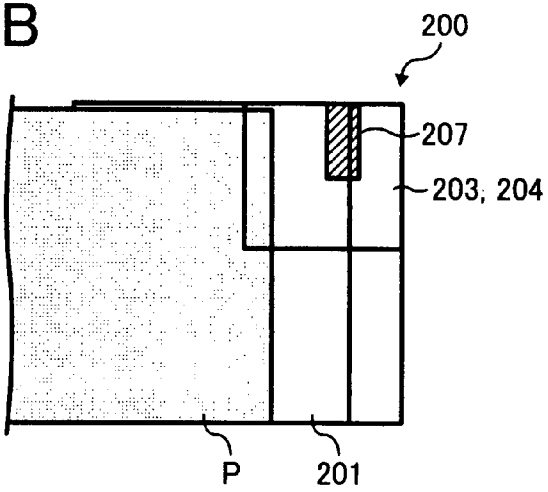
FIG. 4B is a top view of the bypass sheet supplier shown in FIG. 4A.
Figure 5B:
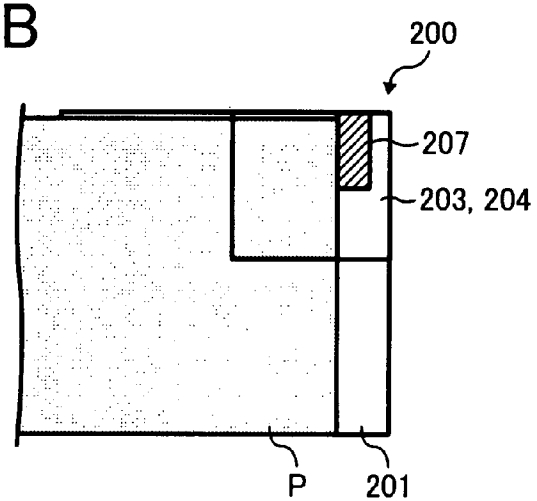
FIG. 5B is a top view of the bypass sheet supplier shown in FIG. 5A.
Figure 4A:
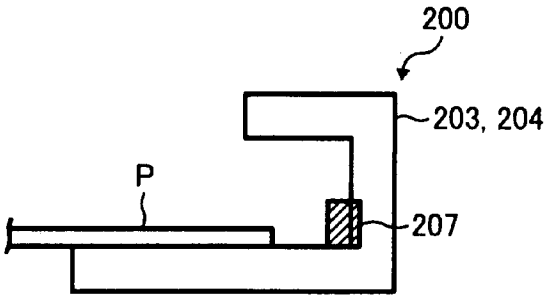
FIG. 4A is a side view of the bypass sheet supplier shown in FIG. 3A.
Figure 5A:
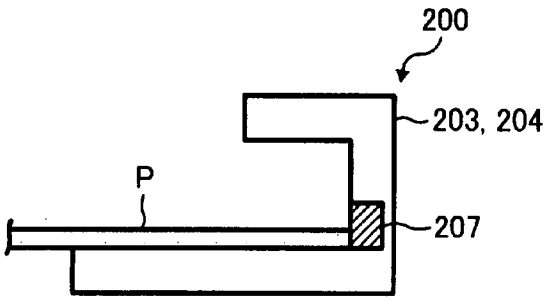
FIG. 5A is a side view of the bypass sheet supplier shown in FIG. 3B.

FIGS. 4A and 5A illustrate a side view of the bypass sheet supplier 200. FIGS. 4B and 5B illustrate a top view of the bypass sheet supplier 200. As illustrated in FIGS. 4A, 4B, 5A and 5B, the bypass sheet supplier 200 further includes a sheet sensor 207. The sheet sensor 207 is disposed in one of the side fences 203 and 204 or both and detects whether an edge of the sheet P contacts an end contact portion of the side fences 203 and/or 204 or not. As described above in connection with the example of FIG. 2, the side fences 203 and 204 are interlocked via the rack and the pinion to simultaneously slide. Therefore, the sheet sensor 207 may be (but does not need to be) disposed in one of the side fences 203 and 204 to reduce production costs. In FIGS. 4A and 4B, the sheet P does not contact the end contact portion of the side fences 203 and/or 204. In FIGS. 5A and 5B, the sheet P contacts the end contact portion of the side fences 203 and/or 204. The sheet sensor 207 as illustrated in FIGS. 4A, 4B, 5A, and 5B includes a micro switch and a filler switch which are turned on when the sheet P contacts the end contact portion of the side fences 203 and/or 204. However, the sheet sensor 207 is not limited to the micro switch and the filler switch, but may include at least one optical sensor including a light emitting element and a light receiving element, as described below.

Figure 6A:
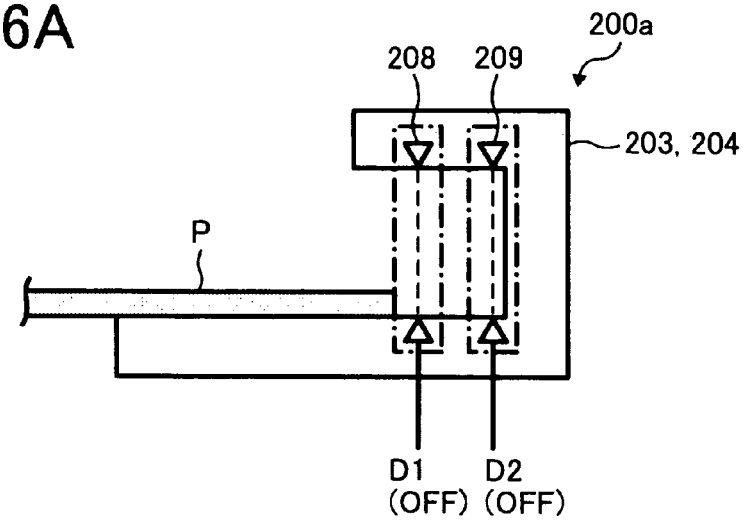
FIG. 6A is a side view of a bypass sheet supplier according to another exemplary embodiment.
Figure 6B:
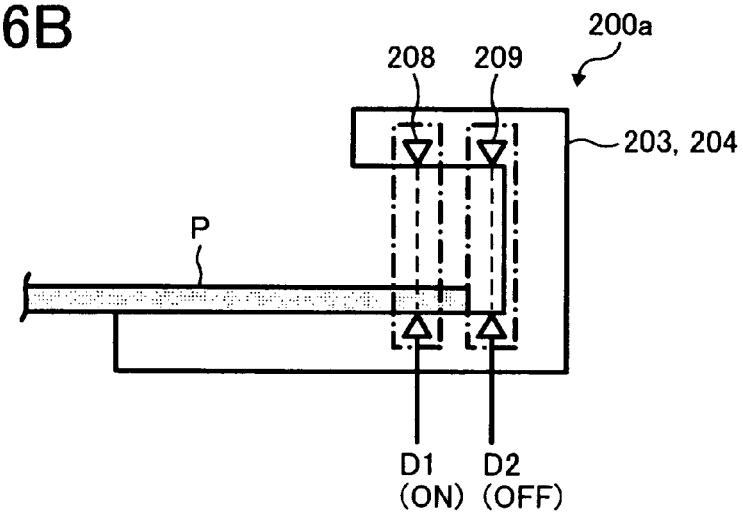
FIG. 6B is another side view of the bypass sheet supplier shown in FIG. 6A.
Figure 6C:
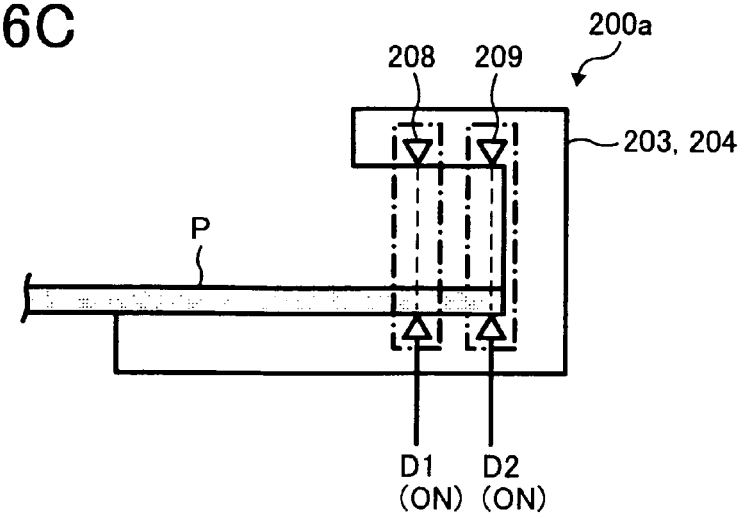
FIG. 6C is yet another side view of the bypass sheet supplier shown in FIG. 6A.

FIGS. 6A through 6C illustrate a side view of a bypass sheet supplier 200*a*, including at least one optical sensor, according to another exemplary embodiment. As illustrated in FIGS. 6A through 6C, the bypass sheet supplier 200*a* includes two optical sensors 208 and 209. The optical sensors 208 and 209 are disposed near the end contact portion of the side fences 203 and/or 204 and detect the sheet P. The other elements of the bypass sheet supplier 200*a* are common to the bypass sheet supplier 200.

A predetermined gap is provided between the optical sensors 208 and 209 in the main scanning direction. Another predetermined gap is provided between the optical sensor 209 and the end contact portion of the side fences 203 and/or 204 in the main scanning direction. The predetermined gaps between the optical sensors 208 and 209 and between the optical sensor 209 and the end contact portion of the side fences 203 and/or 204 may have a common spacing or different spacings. The optical sensor 208 outputs a signal D1 and the optical sensor 209 outputs a signal D2.

Figure 7:
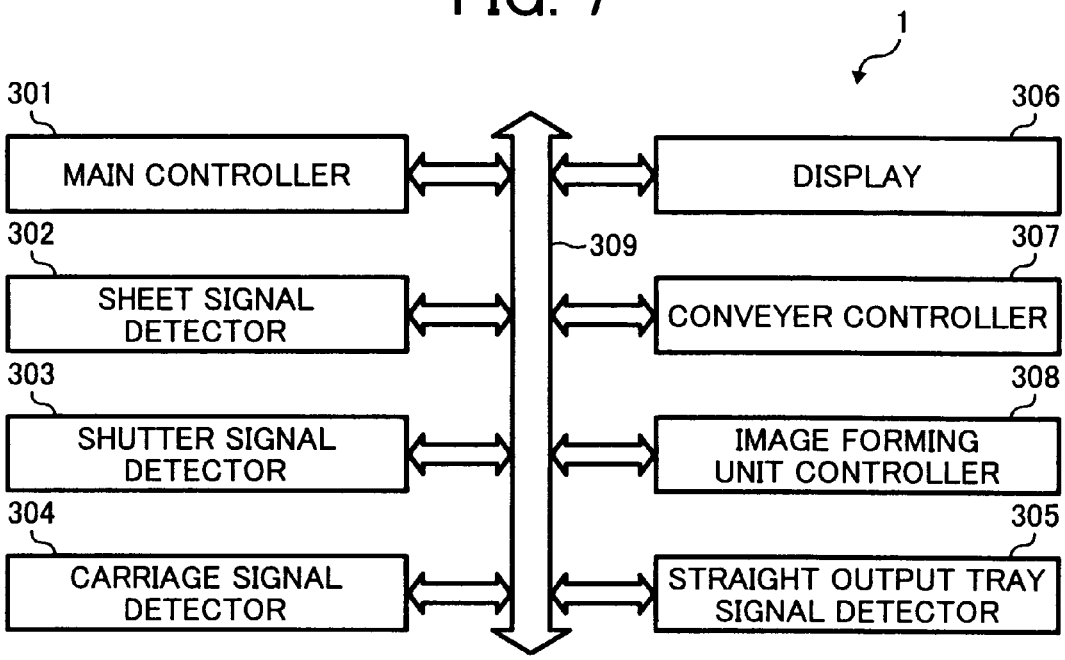
FIG. 7 is a block diagram of a control mechanism of the image forming apparatus shown in FIG. 1.

FIG. 7 is a block diagram of a control mechanism of the image forming apparatus 1. As illustrated in FIG. 7, the image forming apparatus 1 further includes a main controller 301, a sheet signal detector 302, a shutter signal detector 303, a carriage signal detector 304, a straight output tray signal detector 305, a display 306, a conveyer controller 307, an image forming unit controller 308, and an internal bus 309.

The main controller 301 includes a CPU (central processing unit), a ROM (read-only memory) for storing a control program executed by the CPU and other data, a RAM (random access memory) for temporarily storing image data or the like, and a nonvolatile memory (e.g., NVRAM (nonvolatile random access memory)) for saving data even when the image forming apparatus 1 is powered off. The sheet signal detector 302 receives from the sheet sensor 207, the optical sensor 208, or the optical sensor 209 a signal indicating whether or not the sheet P contacts the end contact portion of the side fences 203 and/or 204. The shutter signal detector 303 receives from a shutter sensor (described below) a signal indicating whether or not a foremost edge of the sheet P contacts the shutter 206. The carriage signal detector 304 receives from the carriage sensor 27 a signal indicating whether or not the carriage 23 is lifted up to the predetermined height when an image is to be formed on thick paper or an OHP transparency. The straight output tray signal detector 305 receives a signal indicating whether or not the straight output tray 181 is opened so that the sheet P may be output onto the straight output tray 181 when an image is to be formed on thick paper or an OHP transparency. The display 306 displays a guidance. The conveyer controller 307 controls the sub-scanning direction conveyer 3, the output conveyer 7, and the like. The image forming unit controller 308 controls the image forming unit 2. The internal bus 309 connects the main controller 301, the sheet signal detector 302, the shutter signal detector 303, the carriage signal detector 304, the straight output tray signal detector 305, the display 306, the conveyer controller 307, and the image forming unit controller 308 with each other.

Figure 8:
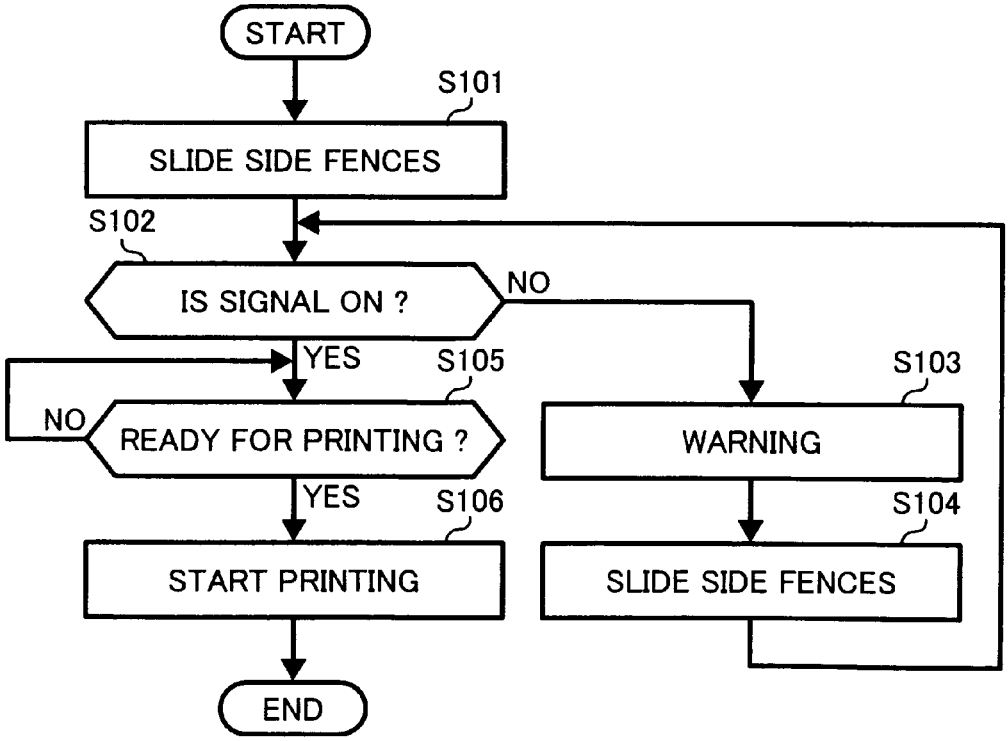
FIG. 8 is a flowchart illustrating operations of the bypass sheet supplier shown in FIGS. 4A, 4B, 5A, and 5B.

FIG. 8 is a flowchart illustrating operations of the bypass sheet supplier 200 including the sheet sensor 207 as illustrated in FIGS. 4A through 5B. In step S101, a user inserts a sheet P into the bypass tray 201 and slides the side fences 203 and/or 204 to regulate the sheet P in the main scanning direction. In step S102, the sheet signal detector 302 determines whether or not a signal sent from the sheet sensor 207 is an ON signal. When an edge of the sheet P does not contact the end contact portion of the side fences 203 and/or 204 and thereby the signal sent from the sheet sensor 207 is an OFF signal (i.e., NO in step S102), the main controller 301 warns the user that the sheet P is not properly set in the bypass tray 201 by issuing a warning or a guidance (e.g., an alarm or a warning message displayed on the display 306) in step S103. In step S104, the user slides the side fences 203 and/or 204 again so that the edge of the sheet P contacts the end contact portion of the side fences 203 and/or 204. When the edge of the sheet P contacts the end contact portion of the side fences 203 and/or 204, the sheet signal detector 302 receives the ON signal from the sheet sensor 207 (i.e., YES in step S102). In step S105, whether or not the image forming apparatus 1 is ready for printing is determined. For example, the carriage signal detector 304 determines whether or not the carriage 23 is lifted up to the predetermined height. The straight output tray signal detector 305 determines whether or not the straight output tray 181 is opened. The conveyer controller 307 determines whether there is no sheet P being conveyed in the conveyers and/or conveying paths including the sub-scanning direction conveyer 3 and the output conveyer 7. When the image forming apparatus 1 is ready for printing (that is, YES in step S105), the image forming unit controller 308 causes the image forming unit 2 to start printing on the sheet P sent from the bypass tray 201 in step S106.

Figure 9:
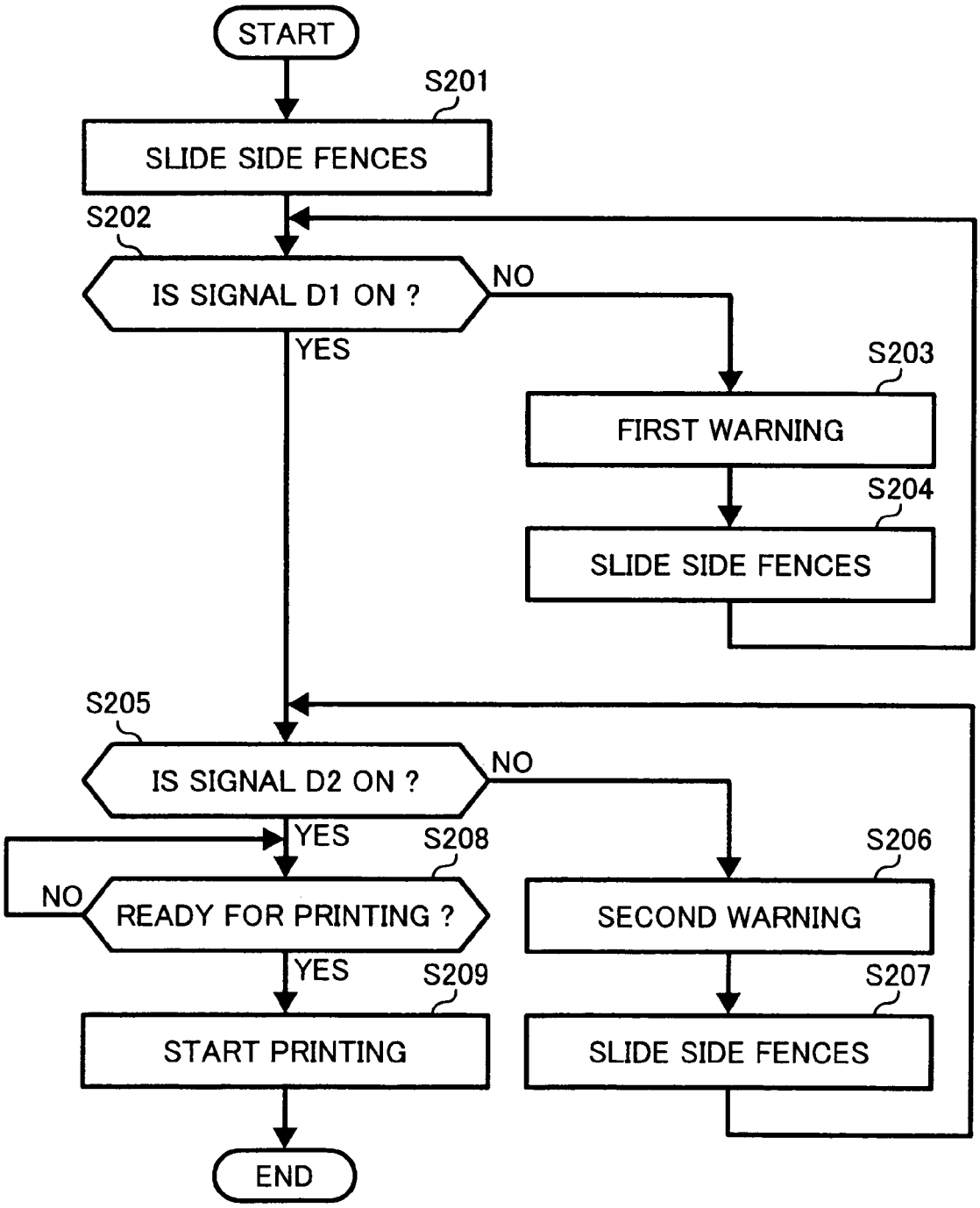
FIG. 9 is a flowchart illustrating operations of the bypass sheet supplier shown in FIGS. 6A, 6B, and 6C.

FIG. 9 is a flowchart illustrating operations of the bypass sheet supplier 200*a* including the optical sensors 208 and 209 as illustrated in FIGS. 6A through 6C. In step S201, a user inserts a sheet P into the bypass tray 201 and slides the side fences 203 and/or 204 to regulate the sheet P in the main scanning direction. In step S202, the sheet signal detector 302 determines whether or not the signal D1 which is output and sent from the optical sensor 208 is an ON signal. When the sheet P does not contact the end contact portion of the side fences 203 and/or 204 and does not reach a detecting position of the optical sensor 208 as illustrated in FIG. 6A, the signal D1 is an OFF signal (i.e., NO in step S202) and the main controller 301 warns the user that the sheet P is not properly set in the bypass tray 201 by issuing a warning or a guidance (e.g., a first alarm or a first warning message displayed on the display 306 and including "Slide the side fences toward the sheet.") in step S203. In step S204, the user slides the side fences 203 and/or 204 again. When the sheet P reaches the detecting position of the optical sensor 208 and the signal D1 is an ON signal (i.e., YES in step S202)., the sheet signal detector 302 determines whether or not the signal D2 which is output and sent from the optical sensor 209 is an ON signal in step S205. When the sheet P reaches the detecting position of the optical sensor 208 but does not reach a detecting position of the optical sensor 209 as illustrated in FIG. 6B, the signal D1 is an ON signal and the signal D2, which is output from the optical sensor 209, is an OFF signal. When the signal D2 is an OFF signal (i.e., NO in step S205), the main controller 301 warns the user that the sheet P is not properly set in the bypass tray 201 again by issuing a warning or a guidance (e.g., a second alarm or a second warning message displayed on the display 306 and including "Slide the side fences further toward the sheet.") in step S206. In step S207, the user slides the side fences 203 and/or 204 again. When the sheet P contacts the end contact portion of the side fences 203 and/or 204 and thereby reaches the detecting position of the optical sensor 209 as illustrated in FIG. 6C, the signal D2 is an ON signal (i.e., YES in step S205). In step S208, whether or not the image forming apparatus 1 is ready for printing is determined. For example, the carriage signal detector 304 determines whether or not the carriage 23 is lifted up to the predetermined height. The straight output tray signal detector 305 determines whether or not the straight output tray 181 is opened. The conveyer controller 307 determines whether or not there is no sheet P being conveyed in the conveyers and/or conveying paths including the sub-scanning direction conveyer 3 and the output conveyer 7. When the image forming apparatus 1 is ready for printing (if YES is selected in step S208), the image forming unit controller 308 causes the image forming unit 2 to start printing on the sheet P sent from the bypass tray 201 in step S209.

As described above, the bypass sheet suppliers 200 and 200*a* may detect the sheet P which is not regulated in the main scanning direction in which the recording heads 24 scan before the sheet P is sent towards the image forming unit 2 so as to prevent the sheet P from being skewed or jammed during printing.

Figure 10A:
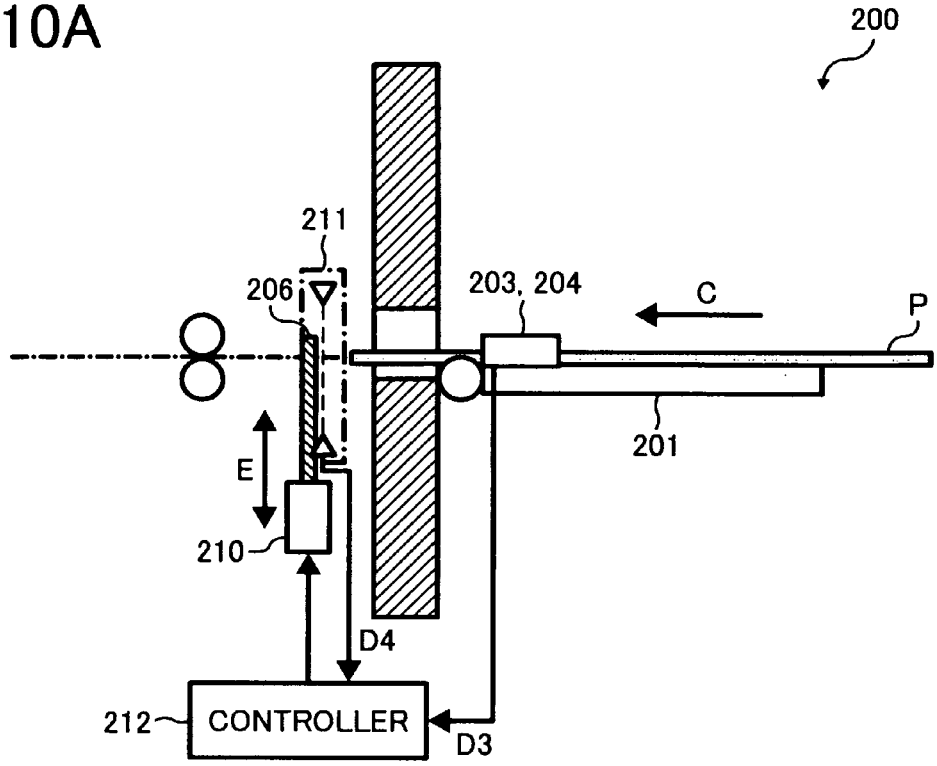
FIG. 10A is a front view of a shutter mechanism of the bypass sheet supplier shown in FIG. 2.
Figure 10B:
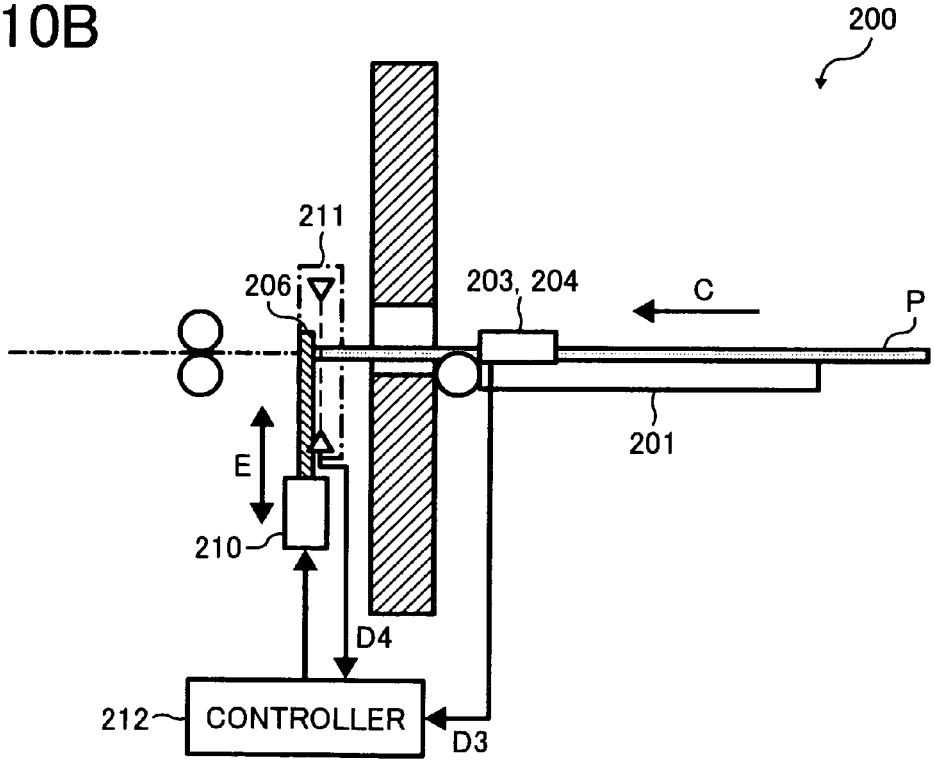
FIG. 10B is another front view of the shutter mechanism shown in FIG. 10A.
Figure 10C:
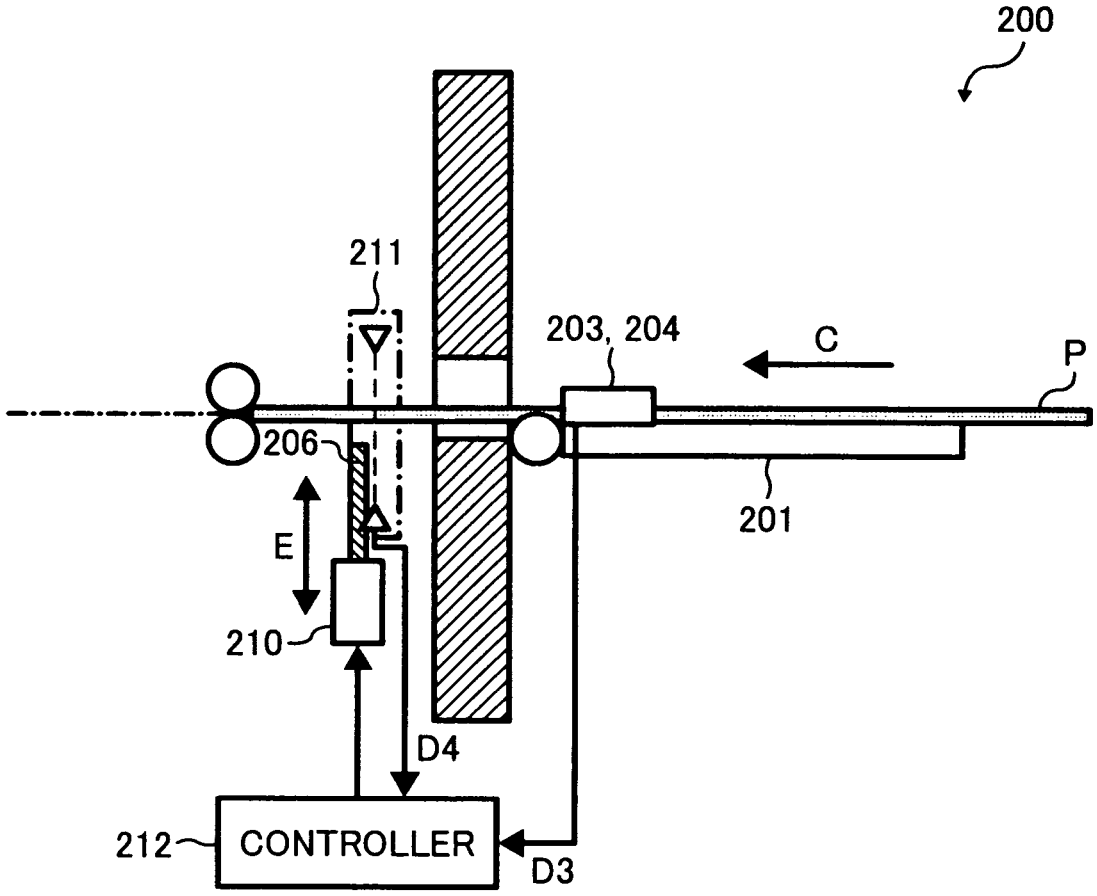
FIG. 10C is yet another front view of the shutter mechanism shown in FIG. 1OA.

FIGS. 10A through 10C illustrate a structure of a shutter mechanism of the bypass sheet supplier 200, which is common to the bypass sheet supplier 200*a*. As illustrated in FIGS. 10A through 10C, the bypass sheet supplier 200 further includes a solenoid 210, a shutter sensor 211, and a controller 212. The solenoid 210 is connected with the shutter 206 and moves the shutter 206 upward and downward (i.e., directions E). The shutter sensor 211 is disposed near an end contact portion of the shutter 206 which contacts the sheet P and detects whether or not the sheet P contacts the shutter 206. The controller 212 controls the solenoid 210.

The sheet sensor 207 provided in the side fences 203 and/or 204 outputs a signal D3 and the shutter sensor 211 outputs a signal D4. The signals D3 and D4 are input to the controller 212. When the controller 212 receives an ON signal D3 and an OFF signal D4, the controller 212 drives the solenoid 210 to open the shutter 206. When the controller 212 receives an OFF signal D3 and an ON signal D4, the controller 212 does not drive the solenoid 210 to keep the shutter 206 closed.

Figure 11:
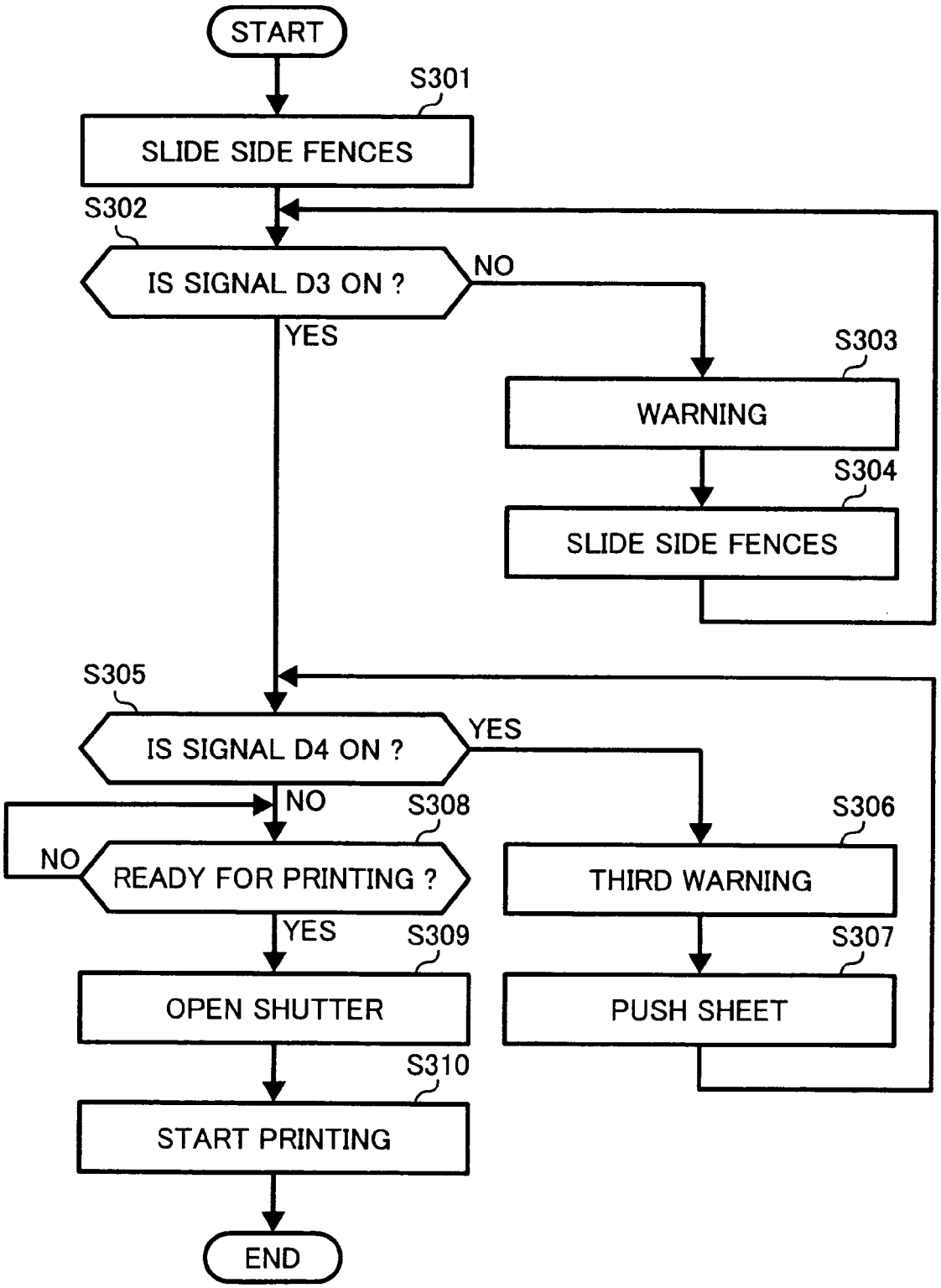
FIG. 11 is a flowchart illustrating operations of the bypass sheet supplier shown in FIGS. 10A, 10B, and 10C.

FIG. 11 is a flowchart illustrating operations of the bypass sheet supplier 200 including the shutter 206 as illustrated in FIGS. 10A through 10C. The flowchart illustrated in FIG. 11 is also applicable to the bypass sheet supplier 200*a*. In step S301, a user inserts a sheet P into the bypass tray 201 and slides the side fences 203 and/or 204 to regulate the sheet P in the main scanning direction. In step S302, the sheet signal detector 302 determines whether or not the signal D3 which is output and sent from the sheet sensor 207 is an ON signal. When the sheet P does not contact the end contact portion of the side fences 203 and/or 204 and thereby the signal D3 is an OFF signal (i.e., NO is selected in step S302), the main controller 301 warns the user that the sheet P is not properly set in the bypass tray 201 by issuing a warning or a guidance (e.g., an alarm or a warning message displayed on the display 306) in step S303. In step S304, the user slides the side fences 203 and/or 204 again. When the sheet P contacts the end contact portion of the side fences 203 and/or 204 and thereby the signal D3 is the ON signal (i.e., YES is selected in step S302), the shutter signal detector 303 determines whether or not the sheet P contacts the shutter 206. Specifically, when the foremost edge of the sheet P does not reach the shutter 206 and a detecting position of the shutter sensor 211 as illustrated in FIG. 10A and thereby the signal D4 is an ON signal (i.e., if YES is selected in step S305), the main controller 301 warns the user that the sheet P is not properly set in the bypass tray 201 again by issuing a warning or a guidance (e.g., a third alarm or a third warning message displayed on the display 306 and including "Push the sheet into the bypass tray.") in step S306. In step S307, the user pushes the sheet P into the bypass tray 201. When the foremost edge of the sheet P contacts the shutter 206 as illustrated in FIG. 10B, the signal D4 is an OFF signal (i.e., NO is selected.in step S305). In step S308, whether or not the image forming apparatus 1 is ready for printing is determined. For example, the carriage signal detector 304 determines whether or not the carriage 23 is lifted up to the predetermined height. The straight output tray signal detector 305 determines whether or not the straight output tray 181 is opened. The conveyer controller 307 determines whether or not there is no sheet P being conveyed in the conveyers and/or conveying paths including the sub-scanning direction conveyer 3 and the output conveyer 7. When the image forming apparatus 1 is ready for printing (if YES is selected in step S308), the controller 212 causes the solenoid 210 to move the shutter 206 downward as illustrated in FIG. 10C in step S309 when the controller 212 receives the ON signal D3 and the OFF signal D4. The shutter 206 is opened and the sheet P is led towards the image forming unit 2. The image forming unit controller 308 causes the image forming unit 2 to start printing on the sheet P sent from the bypass tray 201 in step S310.

In the bypass sheet suppliers 200 and 200*a*, the side fences 203 and/or 204 regulate the sheet P in the main scanning direction in which the recording heads 24 scan. The side fences 203 and/or 204 include the sheet detector 207, the optical sensor 208, and/or the optical sensor 209 for detecting whether or not an edge of the sheet P extending in the sub-scanning direction contacts the side fences 203 and/or 204. Thus, the user may easily and properly insert the sheet P into the bypass sheet supplier 200 or 200*a*. As a result, the sheet P may not be skewed or jammed during printing.

The sheet sensor 207 includes a switch sensor configured to detect that the edge of the sheet P extending in the sub-scanning direction contacts the side fences 203 and/or 204 when the side fences 203 and/or 204 push the edge of the sheet P. The optical sensors 208 and 209 are configured to optically detect the edge of the sheet P at the detecting positions provided near the end contact portion of the side fences 203 and/or 204 that the edge of the sheet P contacts. When the sheet sensor 207, the optical sensor 208, or the optical sensor 209 does not detect the sheet P, the alarm or the warning message warns the user to properly set the sheet P. Thus, the bypass sheet suppliers 200 and 200*a* may detect whether or not the sheet P is properly set with a simple mechanism. The warning may prevent an operation error of the user.

The optical sensors 208 and 209 are arranged in a state that the predetermined gap is provided between the optical sensors 208 and 209 and between the end contact portion of the side fences 203 and/or 204 and the optical sensor 209. Different alarms or warning messages may be issued in accordance with detection results of the optical sensors 208 and 209 so as to give the user detailed, proper instructions.

When the sheet sensor 207, the optical sensor 208, or the optical sensor 209 does not detect the sheet P, the sheet P may not be sent towards the image forming unit 2 for printing so as to prevent or reduce malfunctions of the image forming apparatus 1 and to prevent the sheet P from being skewed or jammed during printing.

The shutter 206 regulates the foremost edge of the sheet P in the sub-scanning direction before the sheet P is sent towards the image forming unit 2. Thus, the foremost edge of the sheet P may be easily aligned and the sheet P may be properly set in the bypass sheet supplier 200 or 200*a*.

The shutter sensor 211 is disposed near the end contact portion of the shutter 206 which contacts the sheet P and detects whether or not the foremost edge of the sheet P contacts the shutter 206. Thus, the user may easily and properly insert the sheet P into the bypass sheet supplier 200 or 200*a*.

As a result, malfunctions of the image forming apparatus 1 may be prevented or reduced and the sheet P may not be skewed or jammed during printing.

The shutter 206 is opened when the sheet sensor 207 or the optical sensors 208 and 209 detect that the edge of the sheet P extending in the sub-scanning direction contacts the side fences 203 and/or 204 and the shutter sensor 211 detects that the foremost edge of the sheet P contacts the shutter 206. Thus, the sheet P may not be sent towards the image forming unit 2 when the sheet P is not regulated in the main scanning direction. As a result, the sheet P may not be skewed or jammed during printing.

The shutter 206 is opened when the carriage signal detector 304 detects that the recording heads 24 of the image forming unit 2 are lifted up to the predetermined height in accordance with a thickness of the sheet P. Thus, an image may be properly formed on the sheet P in accordance with the thickness of the sheet P.

The shutter 206 is opened when the conveyer controller 307 detects that there is no sheet P being conveyed in the conveyers and/or conveying paths including the sub-scanning direction conveyer 3 and the output conveyer 7. Thus, the sheet P may not be jammed.

The shutter 206 is opened when the straight output tray signal detector 305 detects that the straight output tray 181 is opened. Thus, the sheet P may not be jammed near the straight output tray 181.

The bypass sheet suppliers 200 and 200*a* may also be provided in an image forming apparatus for forming an image on a recording medium in an electrophotographic method. The image forming apparatus may include an image forming unit including a photoconductor, instead of the image forming unit 2 including the recording heads 24. The image forming apparatus may further include toner containers for storing and supplying toner to the image forming unit, instead of the ink cartridges 26. The shutter 206 may be disposed upstream of the image forming unit or a conveyer for conveying a recording medium towards the image forming unit in the sheet conveyance direction. The shutter 206 may also be disposed near the bypass tray 201 and downstream of the bypass tray 201 in the sheet conveyance direction.

Numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese patent application No. 2005-266452 filed on Sep. 14, 2005 in the Japan Patent Office, the entire contents of which are hereby incorporated herein by reference.

What is claimed is:

1. An image forming apparatus, comprising:

a bypass sheet supplier configured to supply a recording medium and including a bypass tray configured to load the recording medium, a lateral side fence configured to regulate the recording medium in a main scanning direction, and a sensor unit configured to detect whether a lateral edge of the recording medium extending in a sub-scanning direction contacts the lateral side fence;

a control mechanism configured to issue one of a first warning and a first guidance indicating that the recording medium is not properly set on the bypass tray when the recording medium is not contacted by the lateral side fence;

an image forming mechanism configured to form an image on the recording medium sent from the bypass sheet supplier according to image data;

a carriage detector configured to detect whether or not the image forming mechanism is lifted up to a predetermined height in accordance with a thickness of the recording medium;

a conveyer configured to convey the recording medium from the bypass tray to the image forming mechanism;

a conveyer controller configured to determine whether there is no recording medium being conveyed by the conveyer;

an output tray configured to receive the recording medium having the image formed by the image forming mechanism and conveyed from the image forming mechanism without being reversed; and an output tray detector configured to detect an event that the output tray is opened, wherein the bypass sheet supplier further includes a shutter disposed upstream of one of the conveyer and the image forming mechanism in a sheet conveyance direction and configured to regulate a foremost edge of the recording medium in the sub-scanning direction, and a shutter sensor disposed near an end contact portion of the shutter, the shutter being configured to contact the foremost edge of the recording medium and the shutter sensor being configured to detect whether the foremost edge of the recording medium contacts the shutter or not, wherein the control mechanism issues one of a second warning and a second guidance indicating that the recording medium is not properly set on the bypass tray when the foremost edge of the recording medium does not contact the shutter, wherein the control mechanism opens the shutter to convey the recording medium from the bypass tray to the image forming mechanism when the sensor unit detects an event that the lateral edge of the recording medium contacts the lateral side fence, the shutter sensor detects an event that the foremost edge of the recording medium contacts the shutter, the carriage detector detects an event that the image forming mechanism is lifted up to the predetermined height, the conveyor controller determines that there is no recording medium being conveyed, and the output tray detector detects an event that the output tray is opened.

2. The image forming apparatus of claim 1, wherein the sensor unit is disposed in the lateral side fence.

3. The image forming apparatus of claim 1, wherein the sensor unit includes a switch sensor configured to detect an event that the lateral edge of the recording medium contacts the lateral side fence when the lateral side fence pushes the lateral edge of the recording medium.

4. The image fanning apparatus of claim 1, wherein the sensor unit includes an optical sensor configured to optically detect the lateral edge of the recording medium at a detecting position provided near an end contact portion of the lateral side fence which contacts the lateral edge or the recording medium.

5. The image fanning apparatus of claim 1, wherein the sensor unit includes a plurality of optical sensors which are arranged in a state that a predetermined gap is provided between the plurality of the optical sensors and another predetermined gap is provided between an end contact portion of the lateral side fence and one of the plurality of the optical sensors, and wherein the plurality of the optical sensors are configured to optically detect the lateral edge of the recording medium at a detecting position provided near the end contact portion of the lateral side fence which contacts the lateral edge of the recording medium.

6. The image forming apparatus of claim 5, wherein the control mechanism is configured to issue different warning and guidance in accordance with detection results of the plurality of the optical sensors.

7. The image forming apparatus of claim 1, wherein the control mechanism is configured to issue one of a warning and a guidance when the sensor unit does not detect the recording medium.

8. The image forming apparatus of claim 1, wherein the control mechanism is configured to prohibit the recording medium from being sent from the bypass tray towards the image forming mechanism and to prohibit the image forming mechanism from starting forming an image, when the sensor unit does not detect the recording medium.

9. The image forming apparatus of claim 1, wherein the shutter is disposed near the bypass tray and downstream of the bypass tray in a sheet conveyance direction.

10. An image forming method, comprising:

detecting whether or not a recording medium set on a bypass tray is contacted by a lateral side fence configured to regulate the recording medium in a main scanning direction;

issuing one of a first warning and a first guidance indicating that the recording medium is not properly set on the bypass tray when the recording medium is not contacted by the lateral side fence;

detecting whether or not a foremost edge of the recording medium contacts a shutter disposed near the bypass tray and configured to regulate the recording medium in a sub-scanning direction;

issuing one of a second warning and a second guidance indicating that the recording medium is not properly set on the bypass tray when the foremost edge of the recording medium does not contact the shutter;

detecting an event that an image forming mechanism is lifted up to a predetermined height;

detecting an event that there is no recording medium being conveyed;

detecting an event that an output tray, which is to receive the recording medium conveyed from the image forming mechanism without being reversed, is opened;

opening the shutter to convey the recording medium from the bypass tray to the image forming mechanism; and forming an image on the recording medium according to image data.

* * * * *